US006189652B1

(12) United States Patent
Brown et al.

(10) Patent No.: US 6,189,652 B1
(45) **Date of Patent: *Feb. 20, 2001**

(54) LADDER PLATFORM

(75) Inventors: Maurice Brown, Albion, NE (US); Frank Robinson, Carterville, IL (US)

(73) Assignee: Current Products, Inc., Albion, NE (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/364,325

(22) Filed: Jul. 29, 1999

(51) Int. Cl.[7] ..... E06C 7/16; E04G 1/00
(52) U.S. Cl. ..... 182/121; 182/129; 248/238
(58) Field of Search ..... 182/121, 129; 248/238

(56) References Cited

U.S. PATENT DOCUMENTS

| | | | | |
|---|---|---|---|---|
| 62,314 | | 2/1867 | Burt . | |
| D. 158,136 | | 4/1950 | Simon . | |
| 248,014 | | 10/1881 | Boardman . | |
| 271,509 | | 1/1883 | Nolton . | |
| 335,051 | | 1/1886 | Ayres . | |
| 1,452,182 | * | 4/1923 | Butrum | 182/121 |
| 1,735,003 | | 11/1929 | Heidel . | |
| 1,820,315 | | 8/1931 | Miller . | |
| 1,981,423 | | 11/1934 | Lebre . | |
| 2,174,891 | | 10/1939 | Maran . | |
| 2,439,185 | | 4/1948 | Patt . | |
| 2,606,079 | | 8/1952 | White . | |
| 2,871,067 | | 1/1959 | Brogdon . | |
| 2,876,047 | | 3/1959 | LaPlante . | |
| 3,294,197 | | 12/1966 | Kwiatkowski . | |
| 3,454,132 | | 7/1969 | Platino et al. . | |
| 4,085,819 | | 4/1978 | Ohnstad . | |
| 4,331,217 | * | 5/1982 | Stecklow | 182/121 X |
| 4,482,030 | | 11/1984 | Lincourt . | |
| 4,618,030 | * | 10/1986 | Campbell | 182/121 |
| 5,005,668 | | 4/1991 | Nowlan . | |
| 5,044,466 | | 9/1991 | Jacobsmeyer, Jr. . | |
| 5,052,515 | | 10/1991 | Nowlan . | |
| 5,056,620 | | 10/1991 | Zumwalt et al. . | |
| 5,460,241 | * | 10/1995 | La Belle | 192/121 X |

* cited by examiner

*Primary Examiner*—Daniel P. Stodola
*Assistant Examiner*—Hugh B. Thompson
(74) *Attorney, Agent, or Firm*—Cook, Alex, McFarron, Manzo, Cummings & Mehler, Ltd.

(57) ABSTRACT

A removable platform assembly for a ladder. The platform assembly includes a platform of rectangular shape having sides and ends. One of the platform ends is positioned adjacent the ladder and the other is located away from the ladder in the direction of the structure supporting the ladder. A first channel attached to the platform and adapted to be seated on a rung of the ladder. A pair of legs attached to the opposite sides of the platform and extending downwardly from the platform. A second channel attached to the bottoms of the platform legs to seat on a lower rung of the ladder.

3 Claims, 1 Drawing Sheet

LADDER PLATFORM

BACKGROUND AND SUMMARY OF THE INVENTION

This invention is directed to a platform assembly for a ladder which assembly is lightweight yet strong enough to support a person and which can easily be installed on and removed from a conventional ladder. Many attempts have been made to provide a suitable platform assembly for a ladder which assembly is safe to use and comfortable to stand on. One approach has been to provide a platform assembly that is mounted so it extends from the ladder toward the person standing on the ladder or, in other words, an outwardly extending platform. Another approach has been to provide a platform which extends from the ladder away from the person standing on it or, in other words, an inwardly extending platform. An inwardly extending platform is desirable in many instances because it provides less interference with the person climbing the ladder and also provides a center of gravity located inwardly of the ladder or, in other words, towards the vertical surface structure on which the ladder is supported at the upper end of its side rails.

An object of this invention is an inwardly extending ladder platform assembly which is simple to manufacture yet is strong and safe to use because its upper and lower rung engagement channels are located adjacent opposite ends of the vertical legs of the platform assembly.

Another object of this invention is a ladder platform assembly in which the supporting legs of the platform assists the rung engaging channels of the platform to secure the platform against unwanted movement.

Yet another object of this invention is a ladder platform of simplified construction which can be formed of welded pieces of aluminum.

Other objects may be found in the following specification, claims and drawings.

BRIEF DESCRIPTION OF THE DRAWINGS

The invention is illustrated more less diagrammatically in the following drawings wherein.

DESCRIPTION OF THE PREFERRED EMBODIMENTS

Figure 1:
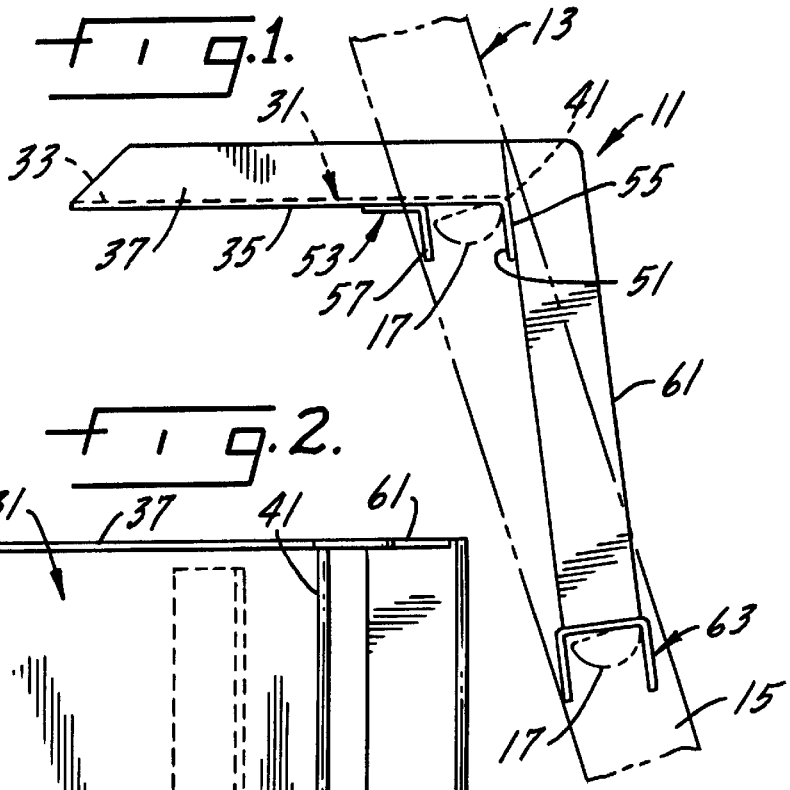
FIG. 1 is a side elevational view of the platform of this invention shown mounted on a ladder which is depicted in phantom lines.

The drawings show a platform assembly 11 which is adapted to be mounted on a conventional ladder 13 of the type having elongated side rails 15 and rungs 17 which are mounted in the side rails and extend there between. As shown in the drawings, the rungs 17 may be of the conventional D-cross section with the upper surface of each rung being flat. As is also conventional, the ladder side rails 15 have upper ends and lower ends with the upper ends contacting a vertical supporting structure such as a building and the lower ends contacting a horizontal supporting surface such as the ground or a floor, both of which supporting surfaces are not shown in the drawings for clarity of illustration.

The platform assembly 11 includes a rectangular platform 31 which preferably is formed of a heavy aluminum plate having an upper surface 33 and a lower surface 35 with the sides of the platform upturned to provide side walls 37. The platform is formed with opposite end edges with the end edge 41 adjacent the ladder referred to as the ladder edge and the other edge facing the vertical support structure referred to as the distal end edge.

Figure 2:
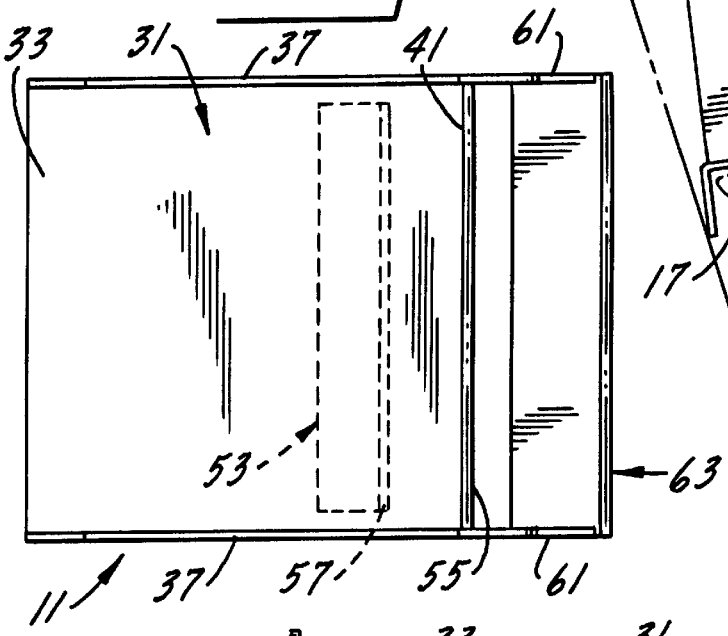
FIG. 2 is a top plan view of the platform of this invention.
Figure 3:
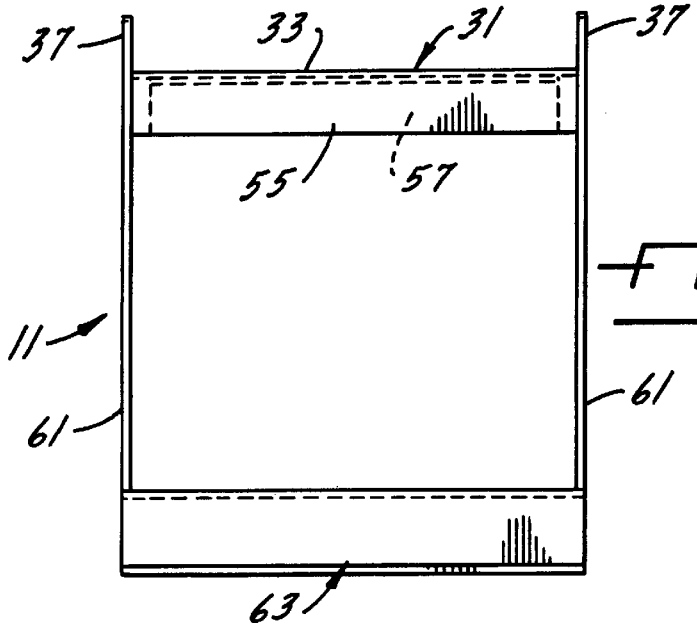
FIG. 3 is a front elevational view of the platform of this invention.

A first downwardly opening channel 51 is formed on the underside 35 of the platform by welding a somewhat L-shaped aluminum angle bracket 53 to the lower surface 35 of the platform at a location inwardly of a turned down portion 55 of the ladder edge of the platform. For ease of seating on a rung 17 of a ladder, the downward leg 57 of the L-shaped angle bracket 53 and the turned down ladder end edge 55 of the platform are formed parallel to each other but have an included angle of greater than 90° relative to the underside 35 of platform 31. As shown in FIGS. 2 and 3 of the drawings, the L-shaped angle bracket 53 does not extend the entire width of the platform but terminates short of the edges thereof to provide ease in seating the channel 51 on a rung 17 of a ladder.

A pair of metal side legs 61 are fastened as by welding to the platform 31 and extend downwardly therefrom at an included angle of slightly more than 90° relative to the platform. A second channel 63, also formed of aluminum, is welded to the bottoms of the side legs 61 of the platform assembly and is adapted to seat on a rung 17 of the ladder located immediately below the next higher rung of the ladder.

The platform assembly 11 of this invention is inwardly extending, that is located inwardly of the ladder between the ladder and its vertical supporting structure. This arrangement provides minimum interference with a person climbing the ladder and also locates the center of gravity of the person standing on the ladder inside a triangle formed by the ladder side rails, the vertical support structure against which the ladder is leaning, and the ground or floor on which the ladder is supported, thus providing greater stability when a person is standing on the ladder. The stability of the platform is also improved while creating minimum interference with the user by locating the first channel 51 at the top of the platform affixed to the side legs of the platform assembly and the bottom or second channel 63 attached to the bottom of the side legs of the platform assembly so that downward forces created by the person standing on the platform 31 are directed parallel to each other.

What is claimed is:

1. A removable platform for attachment to a runged ladder which is inclined to the vertical when in use thereby defining a somewhat upwardly facing side of said ladder to accommodate a user and a somewhat downwardly facing side of said ladder away from said user, said removable platform comprising;

a platform of rectangular shape having sides, a first end, a second end and an under side, said second platform end adapted to be positioned adjacent a first rung of said ladder so that said first platform end passes between side rails of said ladder and is positioned on said somewhat downwardly facing side of said ladder, a first downwardly opening channel attached to said second platform end so as to be positioned adjacent said first rung of said ladder and adapted to be seated on said first rung, a leg attached to each side of said platform and extending downwardly from said platform, said legs located at said second platform end, a second downwardly opening channel attached to said legs at their bottoms with said second channel adapted to be positioned on a lower rung of said ladder below said first rung, and said first downwardly opening channel defined by an angle bracket attached to the under side of said second platform end and a downturn edge of said platform.

2. The platform assembly of claim 1 in which said upper ends of said legs fasten to said down turned ladder edge of said platform.

3. The platform assembly of claim 1 wherein said platform is adapted to be located on the downwardly facing side of said ladder to provide minimal interference during ascent of the ladder by the user.

* * * * *